US007082741B2

(12) United States Patent
Brown

(10) Patent No.: US 7,082,741 B2
(45) Date of Patent: Aug. 1, 2006

(54) SADDLE CORRECTING DEVICE HAVING FOUR MOLDED AND SLOTTED PROTECTIVE SHIELDS

(76) Inventor: Roy Leonard Brown, Rt. 6, Box 109, Nevada, MO (US) 64772

( * ) Notice: Subject to any disclaimer, the term of this patent is extended or adjusted under 35 U.S.C. 154(b) by 0 days.

(21) Appl. No.: 10/944,960

(22) Filed: Sep. 17, 2004

(65) Prior Publication Data

US 2006/0059869 A1 Mar. 23, 2006

(51) Int. Cl.
*B68C 1/04* (2006.01)
*B68C 3/08* (2006.01)

(52) U.S. Cl. ..... 54/44.3; 54/66

(58) Field of Classification Search ..... 54/44.3, 54/44.5, 65, 66

See application file for complete search history.

(56) References Cited

U.S. PATENT DOCUMENTS 5,018,341 A * 5/1991 Evertson ..... 54/66
5,456,072 A * 10/1995 Stern ..... 54/44.5
5,555,710 A * 9/1996 Smith ..... 54/66
5,575,139 A * 11/1996 Green ..... 54/66
5,802,823 A * 9/1998 Woods ..... 54/66
6,370,850 B1 * 4/2002 Zilka ..... 54/66
6,421,989 B1 * 7/2002 Leson ..... 54/66
6,658,827 B1 * 12/2003 Brownlie ..... 54/66

* cited by examiner

*Primary Examiner*—Teri Pham Luu
*Assistant Examiner*—Elizabeth Shaw
(74) *Attorney, Agent, or Firm*—Wm. Bruce Day

(57) ABSTRACT

A saddle correcting device consisting of 4 protective shields placed over the shoulders and loins of an equine to protect areas of movement often damaged by the rigid structure of a saddle. The shields are placed upon, or within, a pair of connected aprons, under the saddle against the horse. The shields are molded to the general shape of the equine anatomy they are to protect and slotted to induce flexing in areas necessary to utilize the upward bending actions of the shoulders and downward and inward pressures of the saddle-tree bars. By harnessing these opposing forces, the shields act to keep the corrector device in place, while concurrently holding the saddle rearward of the rotating scapulas. The area of weight distribution is increased under the shields only in the areas of most damage to the musculature of the animal by the typical saddletree. The closeness of the rider to the horse is enhanced because little padding is needed under the saddle.

7 Claims, 4 Drawing Sheets

2D-56

SADDLE CORRECTING DEVICE HAVING FOUR MOLDED AND SLOTTED PROTECTIVE SHIELDS

BACKGROUND OF THE INVENTION

1. Field of the Invention

This invention broadly concerns a device designed to eliminate the pressure areas under a saddletree and impingement to natural movement of the Equine by the framework of the saddle, most often referred to as a tree. More particularly, this invention is concerned with a device consisting of 4 protective shields used against the horse not as padding but to dynamically distribute pressures while correctly positioning said tree on the equines back, concurrently maintaining position of said device, and providing necessary ventilation for said animal and giving close contact to the rider.

2. Description of the Prior Art

1. Many different approaches have been used over the centuries attempting to alleviate the horse from excess and damaging pressures created by the saddletree while carrying it's intended load. At this time none have been completely successful. In past and present the emphasis has been on protecting the equine from the whole saddle. Therefore pads and panel systems have concentrated on insulating the complete load bearing area contacting the equine, of said saddletree. Such pads comprised of: felt, fleece, foams, gels, air, strips of leather, and plastic panels cannot completely follow the drastic changes in shape of the equine's back with even weight bearing capacity. The FLEXIBLE SKIRT SADDLE panel system with a memory was first invented by myself, Roy L. Brown, (U.S. Pat. No. 4,745,734, May 24, 1988). Problems arose in the use of this advancement for weight distribution under the saddle. It would bounce and easily slip foreword on the animal and couldn't carry weight in the depression behind the scapula in movement Said depression is constantly changing shape not only from the rotating scapula and contracting muscles, but also the bending of the body of the equine when asked to turn by the rider. One side of the back shortens while the other side lengthens as the horse bends his torso in turning. When said panels or flexible skirts are used attached to the tree or separate, the results are less than desirable to both horse and rider. I know this from first hand experience over the last 18 yr. The float and rebound of said weight bearing panels isolates the rider from the horse and can cause extreme chaffing on the equine's back. Special girths and rigging had to be made and adjusted per an individual animal's anatomy to keep such a system in place reasonably well. If the flexible skirt panels are used behind the scapulas, soring was immediate and severe, the edge of the panel being very thin edge and not made of a rounded and flared shape as a saddletree bar usually is. Therefore in use, the plastic panels must be positioned over the shoulders, thus creating negatives referred to above that had to be dealt with separate of normal saddling.

2. My next attempt to correct the above problems was; Roy L. Brown U.S. Pat. No. 5,435,116 Jul. 25, 1995, Racing saddle. It attempted to move with the scapulas more passively by cutting the panel into a series of fingers reinforced by a strip of nylon webbing at the leading edge, to use said bending forces in unison. It was a slight improvement over my earlier patents but still could not get down into the depression created at the back of the scapula. It still had the problem of allowing the saddle to slip up over the shoulders and onto the neck in the downhill or during quick stops.

3. My next attempt to carry more weight in the depression at the back of the shoulders consisted of a saddle pad with pockets for shims, of which the rider tried to fill said depression behind the shoulders. Roy L. Brown U.S. Pat. No. 6,125,616 Oct. 3, 2000. This pad helped carry the weight in the depression but once the shims were set to the shape of the animal at rest, said shape changed in movement. As well the rider had a hard time knowing how many shims were needed to obtain the optimum results. It was best used with the flexible skirt saddle and did not have broad application outside of that design.

4. I have mainly given examples of my own patents which are associated with the saddling and trying to carry weight over a larger area than is possible with just a tree or regular saddlepads. Saddlepads presently available in the industry try to protect the complete area of the equine's back that is exposed to the saddle, very unlike this new invention. The regular saddlepad can do little to keep a normal saddle from impinging on the rotating scapulas in the downhill or in sudden stops. Rigging and girths often have to be specialized to individual animals for optimum placement of the saddle on a given equine's back.

SUMMARY OF THE INVENTION

1. These and many other problems are largely solved by the saddle correcting abilities of the present invention. That is to say, the saddle corrector, according to the present invention, is provided with four protective shields positioned to distribute weight in a dynamic fashion only in the four areas of impingement to movement of the equines anatomy, by the typical saddletree. These shields are preferably made of a thermoset plastic sheet (kydex) or similar resin sheet that is moldable by heat and has a memory so as not to fatigue with constant bending. The protective shields work concurrently preventing excessive pressure from the fixed shape of said saddletree in the same four areas. The right and left shoulders and right and left loins being the four areas of the equines back with most movement being protected by the saddle corrector's four protective shields, placed one on each side, overlying the scapulas and one on each side overlying the loins of the equine. Therefore it does not attempt to protect the whole animals back from the saddletree as has been the objective of prior art 2. The 4 separate shields being sandwiched in an equally spaced pair of connected aprons, are free to move with the compound changes of shape of the equines back while being ridden. Furthermore it is designed to be used with any saddle on any equine and positions said saddle optimally without the need to adjust saddle (attachment) rigging for an individual animal's anatomy. The 4 protective shields of the saddle corrector are preferably positioned in a pair of aprons. These aprons preferably connected at the forward and aft portion of the center of joining said aprons, leaving the center open so as to allow coming together of said aprons as the back drops and opening of the elliptical space between said aprons when back is lifted and straightened. Continual ventilation is provided in the center of the back concurrently and the need to contour the center of the completed device is eliminated. Each apron contains a front and rear protective shield molded to the general anatomical shape of a horse where it is to overlap. These shields are then relief slotted to obtain the flexing qualities desired to shape-to and move-with any animal, dynamically dispersing weight and preventing localized pressures from impingement to movement by the rigid tree sections in the areas of most movement of the animals anatomy. The slotting also provides for ventilation and heat transfer from the animal. Slotting of said shields are configured to position the saddletree to the horse's anatomy as well.

3. Said protective shields are positioned according to the saddle size but are generous in length, in the rear shields, to require only 2 sizes to fit all commonly used saddles. Positioning of the saddle tree on the front shields is the same with any size saddle. The molded shape and slot placement being configured to keep the leading edge of the saddletree bars just back of the scapulas, while the leading edge of the protective shields overlay the aft portion of said scapulas and extend forward of the saddle tree. The intense pressure of the front of the saddletree bars holds the rear upper concave surface of the protective shields in place while the lower concave leading portion of the protective shields are bent upward by the rotating scapulas beneath. Thus the opposing forces are used; with the forward portion of the front shields acting to position the saddletree behind the scapulas as they rotate while pressure, from saddletree bars on the rearward half of said front protective shields, maintains the front protective shields in position over the scapulas. Positioning of saddletree and correcting device are thereby stabilized by said opposing forces.

4. More particularly, the aft protective shields are positioned to prevent the rearward outer edges of the tree bars, that may be angled too sharply for the loins of a given horse, from creating lines of excessive pressure parallel to the vertebral column. If said pressure were allowed to happen the equines back is hollowed by dorsiflexsion, (contraction of the longissimus dorsi) and the back pulls away from the saddle tree in the middle, thereby exerting higher pressures on the ends.

5. The common misconception that a saddle can be fitted while a horse is standing, is what the saddle corrector challenges. It is well known to one experienced in the art that the horse's back comes up in the middle at the walk and rises even more at a trot, when carrying a rider, if not pinched in the wither/shoulder area or jabbed in the loin area. When pain is introduced to the natural moving equine in either of these areas, the horse contracts the longissimus dorsi muscle of the back as an instinctive reaction to said pain. This increases the pain at either or both ends of the saddle tree, thereby becoming a self-perpetuating scenario of which is halted by the present invention. The back is rising and dropping in natural movement at speed, whereas with the saddle corrector in place it is allowed to continue such without undue pressures at the ends of the saddletree, thus avoiding the muscular response that upsets the natural use of said animals back, thereby initiating the selfperpetuating situation described above so common in saddling and riding of the equine.

BRIEF DESCRIPTION OF THE DRAWINGS (each components ID# is continual throughout Fig's)

FIG. 1 is a left side elevational view of the saddle correcting device, in accordance with the present invention, in an assembled condition ready for placement on a horse. It contains 1A-79, 1B-77 and 1C-48, which are sectional drawings of the device to show the shape of the molded plastic shields: 15 forward and 18 aft, at corresponding lines A, B, & C. Identifying view numbers are placed on the underside of the sectional illustrations. 29 is the left apron and outer cover. 4 is a tapered slot, 6 is a parallel slot and 60 is a vent hole in the upper layer of the apron.

Figure 4:
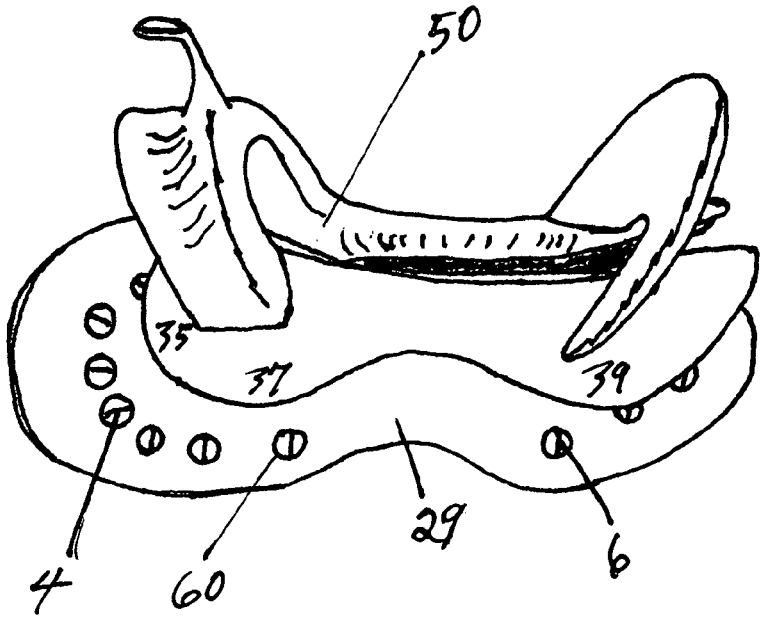

FIG. 4 is a elevated left side perspective view of saddle corrector under a typical saddle tree 50. Ventilation holes 60 are shown in the upper cover layer over slots 4 and 6 in left apron 29, as a preferred ventilation feature.

DESCRIPTION OF THE PREFERRED EMBODIMENT

1. Turning now to the drawings, the saddle correcting device is illustrated in FIGS. 1–4. Broadly speaking the assembly consists of a pair of aprons with four slotted and molded protective shields inserted between layers of felt or other material suitable for use against the equine's skin. Two of the protective shields are in the front and two at the rear.

Figure 1:
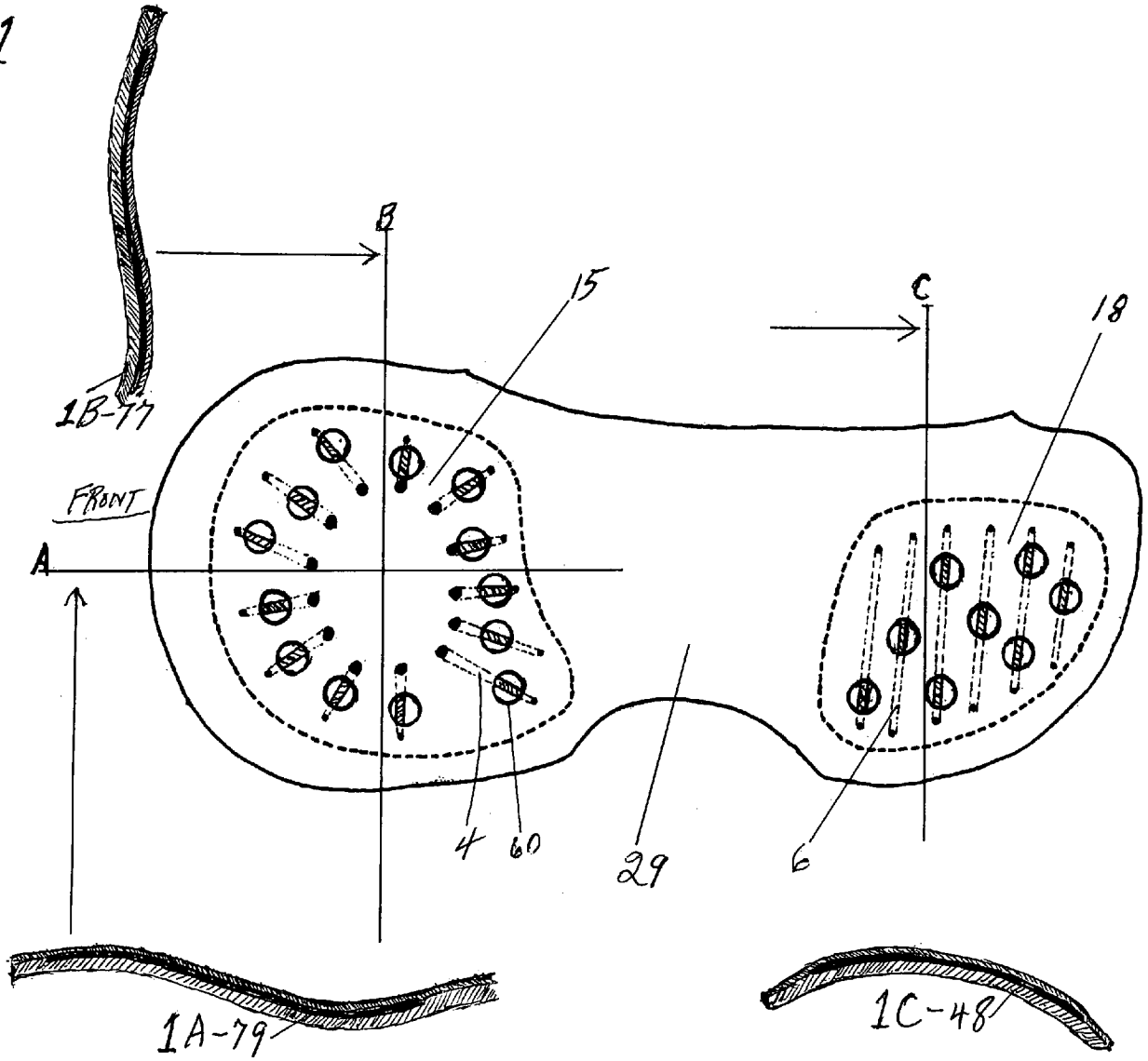
Figure 2:
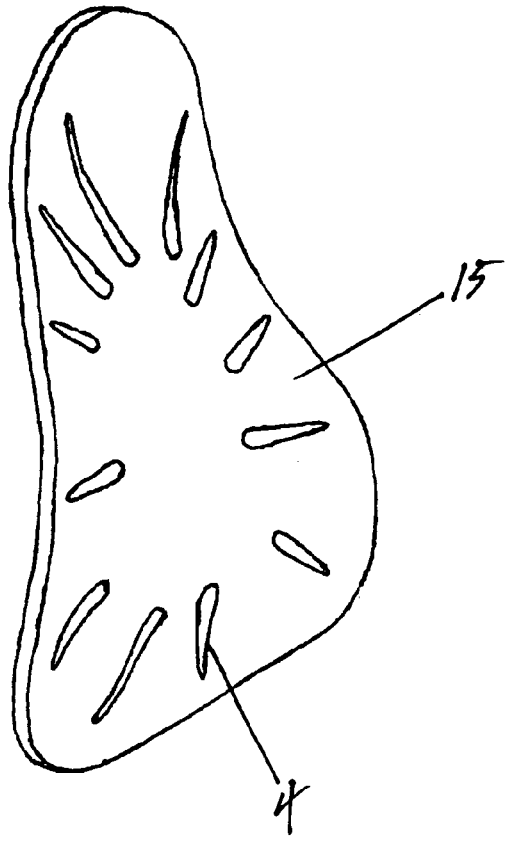
FIG. 2 is an elevated forward quartering view of the left side of front shield. 2D-56 is a frontal sectional of the corrector device at line B FIG. 1. Shield 15 is shown mirrored on the right side as shield 16, in the completed corrector device.
Figure 2:
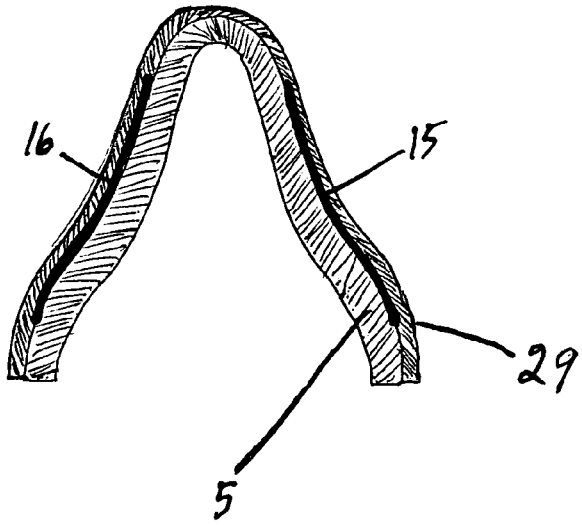

2. In more detail, the saddle correcting device preferably has 2 aprons, a right and a left. Each apron is simply a mirror image of the other. What is shown in FIG. 1 as shield 15 is duplicated as 16 on the right side of the horse, illustrated in 2D-56 FIG. 2. This is the only illustration of both sides of the device in the drawings. Identifying numbers of identical components remain unchanged in all the drawings.

3. The Left Front Shield 15 is shown in a sectional view from the front, at line B, FIG. 1B-77. Shield 15 is a gentle convex shape against the horses withers on the upper ⅓ of it's contact surface, as illustrated by 1B-77 FIG. 1 and 2D-56 FIG. 2, and by said shape its tensile bending strength is lessened against the sensitive upper part of the horse's wither it contacts. The tapered slots 4, FIGS. 1, 2, & 4, being larger toward the center further soften the bending action by removing more material toward the center of the shield 15.

4. The lower portion of front shield 15 is concave against the equines upper ribcage 1A79 & 2D56. It has a higher bending resistance to bar 37 FIG. 4 due to this shape and the slots are fewer and shorter in this area, which carries much of the pressures of the saddletree bar, 37 FIG. 4, on the lower rearward portion of the withers where they join the upper ribcage. This area sustains the highest pressures from both weight and concussion. The damaging localized pressures from foot 37 FIG. 4 of said treebar are dramatically lessened by the shock absorbing qualities and increased area of the elasometric protective shield 15.

5. The wither shoulder area of of the equines anatomy is the most difficult to carry weight on, being it is an arched surface featuring changing shapes made-up of compound curves with the topmost surface of the spinous processes not able to take any pressures from the saddletree without sustaining internal damage. Therefore all weight is concentrated as inward forces due to the downward forces exerted by the arched underside of the saddletree. It is therefore necessary to make the pressure resisting area of front protective shield 15 greater than that of the rear protective shield 18. As illustrated in 15 FIG. 1, the majority of the tapered slots 4 are running in line with the spinal column and saddletree side bars, thereby allowing the saddletree to settle down to the natural shape of the animal through less resistance to bending in that plane. Furthermore the concave shape of 15 beneath the saddletree sidebar as illustrated in 1B-77, FIG. 1, is a natural resting spot for said bar. The tapered slots continue the positioning of said sidebar to protective shield 15 and vice-versa, as the slots remove material from the center of shield 15 and soften the tensile bending strength in two vertical arc's.

6. The bending resistance is increased as slots taper thinnest at the leading edge of protective shield 15. It is the concave shape, 1A-79 against the scapula of this leading edge that cups the scapula and provides the leverage toward line B that ultimately resists forward movement of said saddletree bar and impingement to movement upon the scapula itself.

Figure 3:
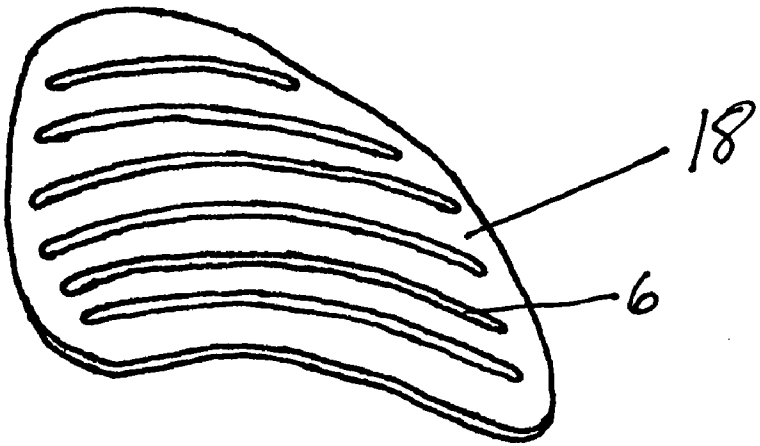
FIG. 3 is a front elevated perspective view of rear left shield 18.

7. The left Rear Shield 18, FIG. 1, is mirrored in the right apron of the device. Rear shield 18, FIG. 3, illustrates the gentle concave shape against the equine's loin, running from the center of the back to the outer upper surface of the ribcage. As is seen in FIG. 3 and FIG. 1, the slots are parallel to each other and run front to rear perpendicular the animals vertebral column. By aligning the slots, 6 FIG. 3, in this manner, the protective shield 18 is free to move up or down with the animal's back preventing the outer edge of saddletree bar, 39 FIG. 4, from inflicting enough pressure in any one spot during said movement of the equine, to cause dorsiflexsion of the segmented longissumus dorsi muscles of the back. The convex surface presented to the edge of the tree sidebar is very resistant to pressures in a plane parallel to the spine and treebar even though fingertip pressure bends the shield up and down, front to rear. It is on the loin, that the lightest of pressure from the treebar's outer edge, 39 FIG. 4, can cause dorsiflexsion of the back, thus increasing the pressures at the ends of said sidebars of the saddletree. The tensile bending strength of the protective shield's, 18 FIG. 3, segments is much increased by the said arched shape of each segment, lying perpendicular to the line of pressure presented by the saddletree bar's outer edge, 39 FIG. 4.

8. It Is in this manner, through simple physics, that shields 15 and 18 in the assembled saddle correcting device, are able to accomplish more than has been previously possible through the spring panel system attached to saddles, or saddle pads that both isolate the rider from feeling the horse under him and cause lateral rolling and forward slippage of the saddle. Thick padding is no longer required in the attempt to protect the equine from the saddle, as the protective shields 15 and 18 function well at 0.093 inch thickness of elasometric polymer. Preferred freestanding thickness of the lower layer of each apron is ¼ inch to ½ inch. Preferred uncompressed thickness of the upper layer of each apron is 1/10th inch to not more than ¼ inch. Therefore the present invention works effectively at 0.443 ths. of an inch uncompressed thickness over shields 15 & 18 and 0.350 ths. inch uncompressed thickness in apron 29 FIGS. 1, 2, & 4, inbetween shields 15 and 18. Less than half the thickness previous saddling devices or saddlepads, the Saddle Correcting Device, FIGS. 1, 2D56, & 4 increases the closeness of rider, positions the saddle and stabilizes saddletree, 50 FIG. 4, for the rider and horse.

9. Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. One such example is the number slots may be increased thereby giving increased flexibility. The material used for the protective shields may be changed to any one of many different suitable polymers other than Kydex made by the Keerdex Corp. The protective shields may be laminated between layers of, or set on top of, a traditional saddlepad, still giving adequate protection to the equine from the saddletree without the ventilation or flexibility benefits of an elliptical cut in the center or ventholes in a top layer of material over the slots.

10. As the inventor I hereby state my intent to rely on the Doctrine of Equivalents to determine and assess the reasonably fair scope of my invention as pertains to any apparatus not materially departing from but outside the literal scope of the invention as set out in the following claims.

What is claimed is:

1. A saddle correcting device with at least two protective forward and rear shields positioned beneath a saddle, the saddle having stirrup mountings and a saddletree, and worn by an equine animal and comprising:

(a) interconnected first and second side aprons configured over the ribs and shoulders of the animal;

(b) one protective shield attached to at least the forward section of first and second aprons, said shields protruding outwardly at least ¼ inch;

(c) including at least two members starting three inches rearward of a leading edge of the two forward shields and 1½ inches forward of the trailing edge of rear shields for interconnecting said aprons; and (d) wherein said protective shields are slotted to achieve multiple firm and flexible areas thereby allowing the control of the saddletree as to placement and position in use on the equine.

2. The saddle correcting device as set forth in claim 1, wherein the slotting are, made to facilitate the shield to follow the movement of the equines anatomy it is to be protecting.

3. The saddle correcting device as set forth in claim 2 that induces the opposing upward forces of scapula rotation and downward pressure from the saddle forward of saddle stirrup mountings, when placed concurrently under and over the forward protective shields, to stabilize and position, thru leverage, a saddle tree rearward of the rotating scapulas.

4. The saddle correcting device as set forth in claim 3 wherein at least one protective shield in the rearward portion of each apron over the loin area of the equine positioned under an outer edge of saddle saddletree prevents excess pressure in said loin area but moving with the equine.

5. The saddle correcting device as set forth in claim 4 further containing an elliptical opening between connecting members of two aprons, to allow for movement of the equine's back without losing contact.

6. A saddle correcting pad for wear by an equine for reducing saddle sores and discomfort, comprising:

(a) a pad having left and right side apron portions;

(b) protective shields within each of the side aprons and placed in the pad so that the protective shields are at least over the shoulder scapula area of the equine;

(c) each said shield being of a semi-rigid material conformed in accordance with an equine shoulder scapula area, and having a plurality of slots facilitating flexing of the shield as the equine moves while simultaneously allowing ventilation to reduce heat and perspiration build-up, thereby providing protective support upon the equine for the saddle and a rider and reducing the possibility of saddle sores and discomfort while permitting the saddle to remain closely mounted upon the equine throughout a broad range of gaits.

7. A saddle correcting pad for wear by an equine for reducing saddle sores and discomfort, comprising:

(a) a pad having left and right side apron portions;

(b) protective shields within each of the side aprons and placed in the pad so that the protective shields are at least over the shoulder scapula area of the equine;

(c) each said shield being of a semi-rigid material conformed in accordance with an equine shoulder scapula area, and having slot relieved areas reducing stress and facilitating flexing of the shield as the equine moves while simultaneously allowing ventilation to reduce heat and perspiration build-up, thereby providing protective support upon the equine for the saddle and a rider and reducing the possibility of saddle sores and discomfort while permitting the saddle to remain closely mounted upon the equine throughout a broad range of gaits.

* * * * *